United States Patent [19]

d'Agostino et al.

[11] Patent Number: 4,726,778

[45] Date of Patent: Feb. 23, 1988

[54] ELECTRICAL AND HYDRAULIC CONNECTIONS ASSEMBLY FOR AN ELECTRO-HYDRAULIC GOVERNOR

[75] Inventors: Guy d'Agostino, Vitry; André Dhainaut, Dammarie les Lys; Jacques. A. A. Petiteau, Le Chatelet en Brie, all of France

[73] Assignee: Societe Nationale D'Etude et de Construction de Moteurs D'Aviation "S.N.E.C.M.A." , Paris, France

[21] Appl. No.: 945,884

[22] Filed: Dec. 24, 1986

[30] Foreign Application Priority Data

Dec. 30, 1985 [FR] France ..... 85 19566

[51] Int. Cl.[4] ..... H01R 4/24

[52] U.S. Cl. ..... 439/78; 439/271; 439/387

[58] Field of Search ..... 439/78, 81, 82, 271, 439/387

[56] References Cited

U.S. PATENT DOCUMENTS 4,165,139 8/1979 Asbill ..... 339/15
4,175,810 11/1979 Holt et al. ..... 439/82
4,205,889 6/1980 Rieman ..... 439/82
4,507,707 3/1985 Willis ..... 361/380
4,560,223 12/1985 Cooneyet et al. ..... 439/387

FOREIGN PATENT DOCUMENTS 2529623 1/1984 France .
304845 1/1955 Switzerland .

*Primary Examiner*—Joseph H. McGlynn
*Attorney, Agent, or Firm*—Oblon, Fisher, Spivak, McClelland & Maier

[57] ABSTRACT

The invention relates to an electro-hydraulic governor particularly for a turbo-jet engine.

All of the electro-hydraulic or electro-pneumatic equipment units such as solenoid valves are arranged on a common plate face of the governor, the latter being provided with a printed circuit connection plate of which the substrate faces the plate surface.

The hydraulic connections are made fluid-tight between the equipment units and the governor by means of apertures with seals therein, which apertures pass through the printed circuit plate.

8 Claims, 6 Drawing Figures

ELECTRICAL AND HYDRAULIC CONNECTIONS ASSEMBLY FOR AN ELECTRO-HYDRAULIC GOVERNOR

BACKGROUND OF THE INVENTION

1. Field of the invention

This invention relates to governors, for example for use in aircraft turbo-jet engines. Such governor assemblies include one part, termed the fixed part, which comprises all of the integrated hydro-mechanical functions while the electro-hydraulic functions are carried out by external components rigid with the fixed part and electrically connected to a current supply, and hydraulically connected with the fixed part of the governor.

2. Summary of the Prior Art

The electrical connections of such components are conventionally external to the governor or to the connecting hydraulic plate associated with the governor, and are provided by means of connectors disposed on the faces of equipment units opposite to the governor or on the lateral faces of the components and by electrical cable means.

The cable assembly or bundle is heavy, bulky and difficult to manipulate. The assembly and disassembly of a governor or of a connecting plate involves the connection and disconnection of the couplings. Each of the movements takes considerable time, is harmful to the long-term viability of the assembly and increases the risk of damage to the connectors and the cable arrays, of which the replacement is very costly.

The invention has as its object to provide the connection of the electro-hydraulic external elements on the governor or a hydraulic connecting plate, in a simultaneous manner with the positioning of the external element on the governor.

It has for a further object to reduce the number of electrical connectors which are necessary, as well as the total of the cables in order to render the operations of maintenance on the governor quicker, more effective and less costly.

SUMMARY OF THE INVENTION

According to the present invention there is provided in an electro-hydraulic governor comprising a fixed hydro-mechanical part having electrical contact means, and hydraulic circuit means, an external, electro-hydraulic, connections part having electrical circuit means for connection to the said electrical contact means of the fixed part, and external hydraulic circuit means for connection to the said hydraulic circuit means of said fixed part, the improvement wherein the fixed part of the governor has a plane face and further comprises an electrical connection plate including contact pins, and electrical connection means, the electrical connection plate being mounted on said plane face, and the external connections part comprises contact assemblies, electrical connection means, and a general connector, the contact pins of the fixed part being arranged to co-operate with respective said contact assemblies of the external connections part, and the electrical connection means of the external part serving to provide an electrical connection between the contact pins of the fixed part and the general connector, and wherein the electrical connection plate has apertures extending normally to the plane of the plate and communicating with the hydraulic circuit means of the fixed part, and capable of communication with the external hydraulic circuit means of the external electro-hydraulic connections part.

The electrical connection plate is preferentially a printed circuit and the electrical contacts are produced by means of conductive rings cooperating with piston-like members turning in the external elements, in order to provide for a self-cleaning arrangement.

The fluid-tightness of the hydraulic connection may be provided either by toroidal seals, or by elastomer layers covering the printed circuit plate.

FIGS. *2a* & *2b* are a section of a second embodiment in accordance with the invention in which the fluid tightness is provided by sealing rings of which a detail is shown to an enlarged scale in FIG. *2a,* while FIG. *2b* illustrates a of fluid tight assembly of lesser thickness than that of FIG. *2a;*

Figure 3:
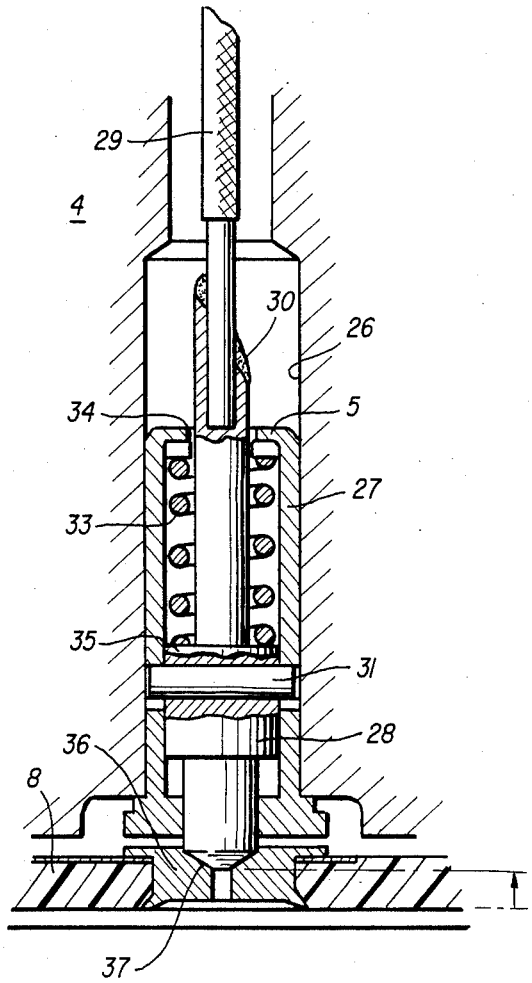
Figure 4:
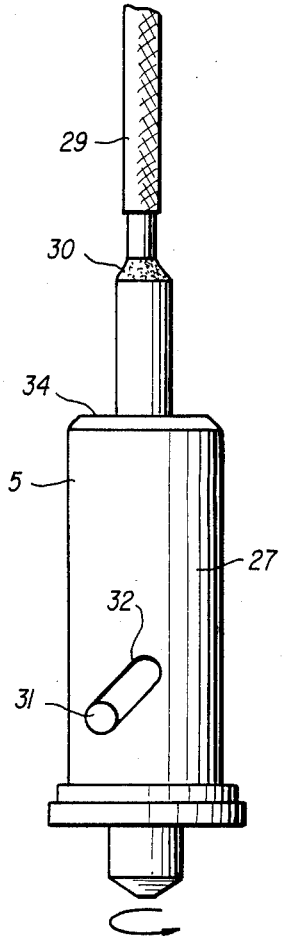

FIG. 3 is a section of an embodiment in accordance with the invention for modular contact assemblies of the external electro-hydraulic elements; and FIG. 4 is an external view of the same contact assembly when withdrawn from its electro-hydraulic element.

DESCRIPTION OF THE PREFERRED EMBODIMENTS

Figure 1:
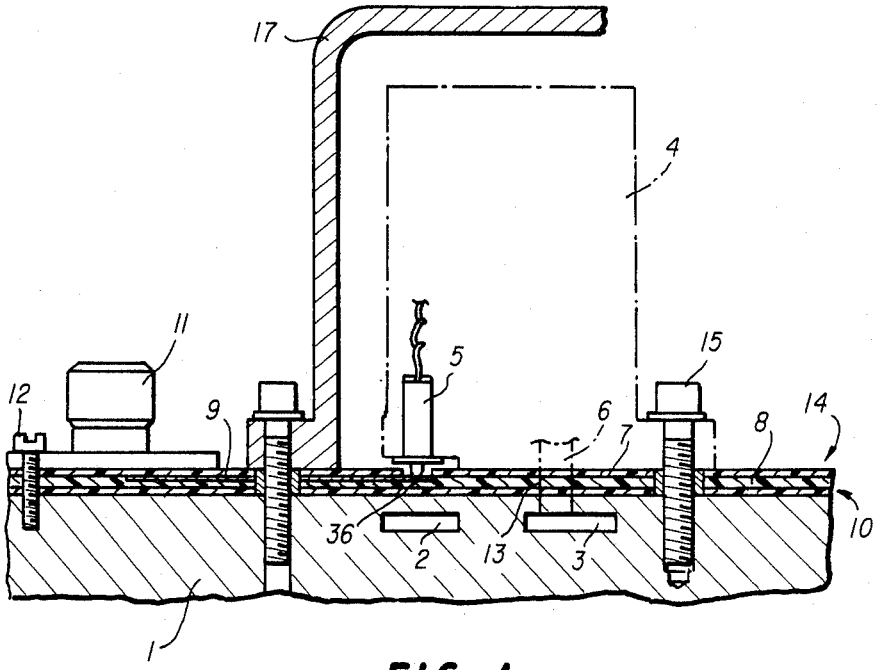
FIG. 1 is a section of a first embodiment in accordance with the invention in which the fluid-tightness of the hydraulic connections is provided by elastomer layers covering a printed circuit plate.

Referring to FIG. 1, the reference 1 represents the fixed part of a governor or of a connecting hydraulic plate associated with a hydro-mechanical governor. In both embodiments the part 1 comprises an external plane surface and will be termed in the text which follows the face plane of the governor. This face plane 1 has hydraulic passages 2, 3 enabling the provision of a hydraulic connection between the hydro-mechanical functions of the governor and of external equipment 4, shown diagrammatically in chain lines, which fulfil electro-hydraulic or electro-pneumatic functions, for example electro-magnetic valves, electro-magnetic taps, or others.

The equipment 4 include an electrical circuit for which the electrical supply is provided by a contact assembly 5 (which will be described hereinafter with reference to FIGS. 3 and 4) and a hydraulic circuit of which only one pipe 6 discharges into the lower face 7 of the equipment 4 has been shown and must be placed in communication with the passage 3 discharging perpendicularly to the plane face 1 in order to render the equipment 4 operational.

According to the invention, all the electro-hydraulic or electro-pneumatic equipments such as 4 are regrouped on a common plane face of the governor and on the latter an electrical connection plate 8 is mounted which is constituted by a metalized printed circuit 9 on a substrate commonly termed a "printed circuit". The plate 8 can be screwed onto the plane face 1 with the interposition of an elastomer layer 10 which will ensure fluid-tight operation between the plate 8 and the plane face 1 of the governor.

The printed circuit 9 provides for an electrical connection between the contact assembly 5 of the equipment 4 and a general connector 11 electrically connected to the circuit 9 and secured by screws 12 on to the plane face of the governor.

The connection plate 8 is provided at 13 with apertures corresponding with the locations of the passages 3 and of the pipes 6 facing it. A second elastomer layer 14 provided on the upper face of the plate 8 will ensure fluid-tight operation between the plate and the overall area of the lower face 7 of the equipment 4. The latter is held on the plane face 1 by known means, for example screws 15 cooperating with tapped bores 16 of the plane face 1, or alternatively by studs and nuts.

A cover 17 may be mounted on the plate 8 in order to cover all the equipment units 4 of the governor, with the exception of the general connector 11.

Figure 2:
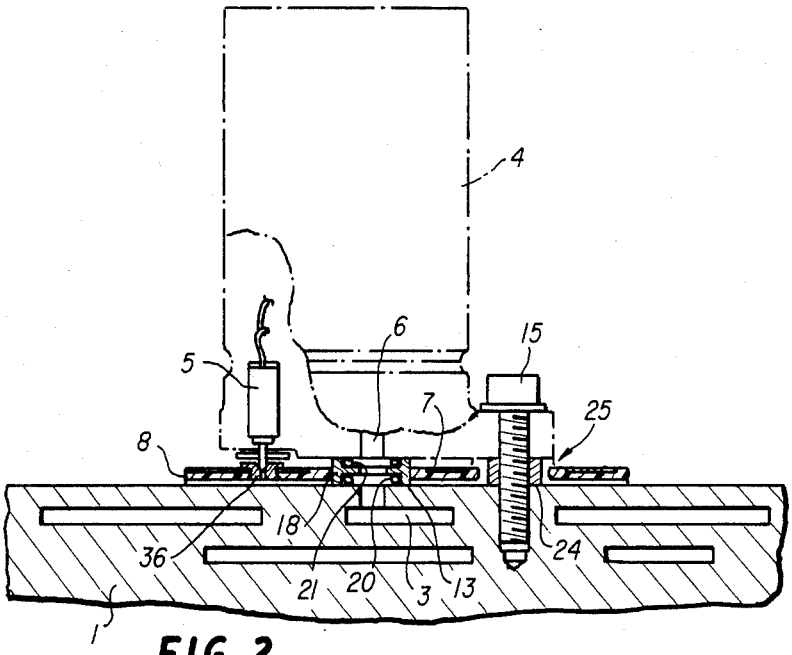

Referring to FIG. 2, the integers common with those of FIG. 1 will maintain the same reference numerals. The only aspect which is modified in this Figure is the way in which the fluid tightness between the equipment 4, the plate 8 and the plane face 1 of the governor is effected.

Figure 2A:
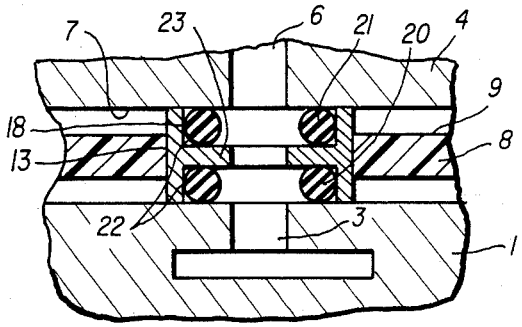

In this embodiment, the hydraulic connection between the pipe 6 and the passage 3 is likewise effected through an aperture 13 of the plate 8 but this aperture has a larger diameter than that of FIG. 1. In the interior of this aperture a sealing ring 18 is located comprising two toroidal seals 20, 21 disposed in two cylindrical recesses 22 on either side of a shoulder 23 separating them (see the detail of FIG. 2*a*).

The sealing ring 18 being of a certain thickness, it is appropriate in order to ensure the parallel arrangement of the plate 8 and of the lower face 7 of the equipment 4 to maintain the spacing of the latter at the securing area 15 by means of a cross-member 24 surrounded by a vibration damper for example of silicone 25.

Figure 2B:
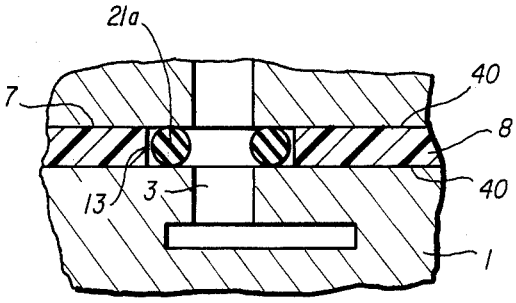

In the modification of FIG. 2*b*, intended to provide equivalent fluid-tightness with a mounting of less bulk, the printed circuit plate 8 is covered by two layers of insulating varnish 40 and a single fluid-tight seal 21*a* is disposed in the opening or aperture 13 of the plate 8, compressed by the engagement of the securing element 15, between the lower face 7 of the element 7 and the plane face 1 of the governor.

By referring now to FIGS. 3 and 4, it will be seen that the contact assembly 5 of the equipment 4 is made in a modular manner so that it can be located in a bore 26 of the element 4. Each contact assembly 5 comprises a cylindrical bush 27 within which a conductive piston-like member 28 can slide longitudinally and which is connected electrically to a braided wire 29 at a soldered joint 30, the piston-like member comprising a transverse pin 31 cooperating with an opening 32 inclined at 45° C. to the bush 27 in order to cause the piston-like member 28 to turn during its translational movement.

A spring 33 compressed between the bottom 34 of the bush and a shoulder 35 of the piston-like member 28 resiliently holds the piston-like member in contact with a contact pin 36 inserted in the plate 8 on the metallic surfaces of the printed circuit.

The contact surface 37 of the pin 36 is gold plated in order to provide the best possible conductivity. Furthermore the rotation of the piston-like member 28 by cooperation with the transverse pin 31 and the opening 32, under the action of a spring 33, provides for self-cleaning of the contact surface 37 with each loading and unloading of the contact assembly.

The electrical circuits 9 of the connection plate 8 provide for all of the electrical connections between the various equipment units such as the electro-hydraulic equipment 4, as well as all of the electrical connections between the printed circuit plate 8 and the exterior (motor equipment and aircraft equipment) are assembled together with a limited number of connectors 11.

The disposition of the securing screws 15 of each equipment unit 4, in combination with the disposition of the screw threads 16 and corresponding holes of the connection plate 8, enable provision of one position and one single position for each electro-hydraulic equipment, which enables a predetermined connection at the instant of the loading/unloading of an equipment unit.

Furthermore, the simultaneous connection of the electrical and hydraulic circuits of each external equipment unit with the corresponding part of the governor is effected by a simple location of the equipment unit 4 on the plate 8 and by its securing by means of the screws 15.

This assembly enables a ready location of:

(i) either on one or several individual equipments, (ii) or the governor and/or the connecting hydraulic plate with the connection plate and all of the equipment units with which it is associated, (iii) or the connection plate with any of the external elements associated without touching the governor.

Without departing from the scope of the invention, it is also possible in order to lighten the device, to integrate the connection plate 8 with the plane 1 of the governor for example by means of simple adhesion.

Furthermore an assembly similar to that which has been provided with electro-pneumatic and/or electro-mechanical equipment units having pneumatic connections and/or mechanical connections with the governor with which they are associated.

Furthermore, the connection plate 8 can also carry components which are purely electrical with a conventional securing means or similar to that which has just been described.

The invention is applicable more particularly to aircraft turbo-jet engines of which the maintenance operations are frequent and must be carried out very quickly but with certainty of correct subsequent operation.

What is claimed is:

1. In an electro-hydraulic governor comprising a fixed hydro-mechanical part having electrical contact means and hydraulic circuit means, an external, electro-hydraulic, connections part having electrical circuit means for connection to the said electrical contact means of the fixed part, and external hydraulic circuit means for connection to the said hydraulic circuit means of said fixed part, the improvement wherein the fixed part of the governor has a plane face and further comprises an electrical connection plate including contact pins, and electrical connection means, the electrical connection plate being mounted on said plane face, and the external connections part comprises contact assemblies, electrical connection means, and a general connector, the contact pins of the fixed part being arranged to co-operate with respective said contact assemblies of the external connections part, and the electrical connection means of the external connections part serving to provide an electrical connection between the contact pins of the fixed part and the general connector, and wherein the electrical connection plate has apertures extending normally to the plane of the plate and communicating with the hydraulic circuit means of the fixed part, and capable of communication with the external hydraulic circuit means of the external electro-hydraulic connections part.

2. A governor according to claim 1 comprising sealing rings engaged in the apertures of the hydraulic connection means, the rings comprising two toroidal seals separated by a shoulder provided within the electrical connection plate.

3. A governor according to claim 1 wherein sealing of the hydraulic connections through the apertures of the connection plate is provided by two layers of elastomer each covering one face of the said plate.

4. A governor according to claim 1 wherein each external, electro-hydraulic connection part comprises securing means for securing it to the governor through the electrical connection plate enabling simultaneous connection and respectively disconnection of the hydraulilc and electrical circuits during the mounting and respectively the demounting of the external connections part.

5. A governor according to claim 1 wherein the electrical connection plate is a printed circuit and the substrate thereof is secured to the plane face of the governor, the printed circuit providing electrical connections between the electro-hydraulic connections and the general contact.

6. A governor according to claim 5 wherein the contact pins comprise conductive rings with a gold-plated surface, the rings being inserted in the printed circuit.

7. A governor according to claim 1 wherein the contact assemblies comprise a conductive piston-like member, a bush and a spring, the piston-like member being rotatable within the bush and being biased by the spring within the bush in order to provide a selfcleaning electrical contact with the respective contact pins.

8. A governor according to claim 7 wherein the piston-like member comprises a transverse pin and wherein the bush comprises an opening inclined with respect to the longitudinal axis of the piston-like member, the transverse pin being engaged in the opening in order to provide for rotation of the latter as it comes into contact with the respective contact pin.

* * * * *